US007438619B2

(12) United States Patent
Staver et al.

(10) Patent No.: US 7,438,619 B2
(45) Date of Patent: Oct. 21, 2008

(54) BUOYANT SWIM GARMENT

(75) Inventors: Brian J. Staver, Maize, KS (US); Nicholas Vaughn, Derby, KS (US)

(73) Assignee: Nuvative, Inc., Wichita, KS (US)

( * ) Notice: Subject to any disclaimer, the term of this patent is extended or adjusted under 35 U.S.C. 154(b) by 0 days.

(21) Appl. No.: 11/379,471

(22) Filed: Apr. 20, 2006

(65) Prior Publication Data

US 2007/0049141 A1 Mar. 1, 2007

Related U.S. Application Data

(60) Provisional application No. 60/711,805, filed on Aug. 26, 2005.

(51) Int. Cl.
*B63C 9/08* (2006.01)

(52) U.S. Cl. ..... 441/115; 441/120

(58) Field of Classification Search ..... 441/88, 441/102, 106–120; 2/69.5, 70
See application file for complete search history.

(56) References Cited

U.S. PATENT DOCUMENTS 1,280,184 A * 10/1918 Dow ..... 2/323
1,308,561 A * 7/1919 Teeters ..... 441/104
1,480,417 A * 1/1924 Potter ..... 441/115
2,500,661 A * 3/1950 Chillemi ..... 441/117
2,521,205 A * 9/1950 David ..... 441/102
3,023,433 A * 3/1962 Davyso ..... 441/115
3,134,994 A 6/1964 Christofferson
3,144,668 A 8/1964 Palesotti
4,301,545 A * 11/1981 Camarena ..... 2/67
4,623,316 A * 11/1986 Ratliff ..... 441/106
5,013,271 A 5/1991 Bartlett
5,060,314 A * 10/1991 Lewis ..... 2/2.5
5,095,549 A * 3/1992 Aldridge ..... 2/304
5,152,706 A * 10/1992 Fister ..... 441/106
5,184,968 A 2/1993 Michalochick et al.
5,459,874 A 10/1995 Meredith
5,582,337 A * 12/1996 McPherson et al. ..... 224/660
5,823,838 A * 10/1998 Darcy et al. ..... 441/106
D426,936 S 6/2000 Shaffer
6,112,327 A * 9/2000 Shaffer ..... 2/67

* cited by examiner

*Primary Examiner*—Ed Swinehart
(74) *Attorney, Agent, or Firm*—Dorsey & Whitney LLP; Jason M. Hunt

(57) ABSTRACT

A swimsuit includes a vest provided with buoyant floatation members, a bottom portion in the form of swim trunks, and a coupling mechanism for selectively coupling the vest to the trunks. The vest may be uncoupled from the swim trunks to permit a user to remove the swim trunks while still wearing the vest, or to remove the vest while still wearing the swim trunks.

7 Claims, 17 Drawing Sheets

BUOYANT SWIM GARMENT

CROSS-REFERENCE TO RELATED APPLICATIONS

This application claims the benefit of related U.S. Provisional Patent Application, Ser. No. 60/711,805, filed Aug. 26, 2005, the contents of which are hereby incorporated by reference.

FIELD OF THE INVENTION

The present invention relates to swimwear. More specifically, the present invention relates to swimwear that includes flotation members for providing enhanced buoyancy.

BACKGROUND OF THE INVENTION

People who are not strong swimmers, and especially children, have a need for using flotation devices in order to participate in swimming, or other water-related activities. One presently available flotation device is a life vest. A life vest is essentially a vest to be worn on the torso of the user that has flotation members, such as foam or inflatable bladders incorporated into its design to improve the buoyancy of the wearer. There are some drawbacks to existing designs for life vests. Namely, they can be cumbersome to attach, because they typically involve some sort of strap that runs betweens the user's legs. They are oftentimes not esthetically pleasing because they do not match the user's swimsuit. In the case of girls or women, they are typically worn over the top portion of a bathing suit or swimsuit, adding an unnecessary additional layer of clothing, and serving to retain moisture within the top portion of the swimsuit after the user has exited the water.

In response to some of these disadvantages, buoyant swimwear has been developed that includes flotation members incorporated into a one-piece swimsuit. However, these one-piece buoyant swimsuits present some disadvantages of their own. Notably, in order to use the restroom, or change a diaper, the entire suit must be removed from a user. When a person is out of the water and does not need the flotation device, a one-piece swimsuit does not allow for the removal of the flotation portion of the suit.

Thus, there exists a need for buoyant swimwear that has improved characteristics.

BRIEF SUMMARY OF THE INVENTION

The present invention, according to one embodiment, is a swim garment that includes a vest portion adapted to be worn on a user's torso. The vest portion includes at least one flotation element. A bottom portion is provided in the form of trunks including a waist band and a pair of leg openings. A coupling device selectively attaches and detaches the vest portion to the bottom portion. The vest may include front and back body portions comprising an elastic material enclosing the flotation element, and side panels of relatively inelastic material. The coupling device may attach to the vest portion at one or more of the side panels.

DETAILED DESCRIPTION

The drawings disclose embodiments of buoyant swimwear according to the present invention. Each of these embodiments include an upper portion and a lower portion that may be worn independently of each other or together as a single unit. When in use, the various embodiments of the buoyant swimwear according to the present invention maintain and/or assist in maintaining the wearer in a floating position in the water. When not in the water, a user may remove the buoyant top portion for comfort and freedom of movement. The bottom portion may be pulled down to use the restroom or change a diaper without the need to remove the upper portion.

Figure 1:
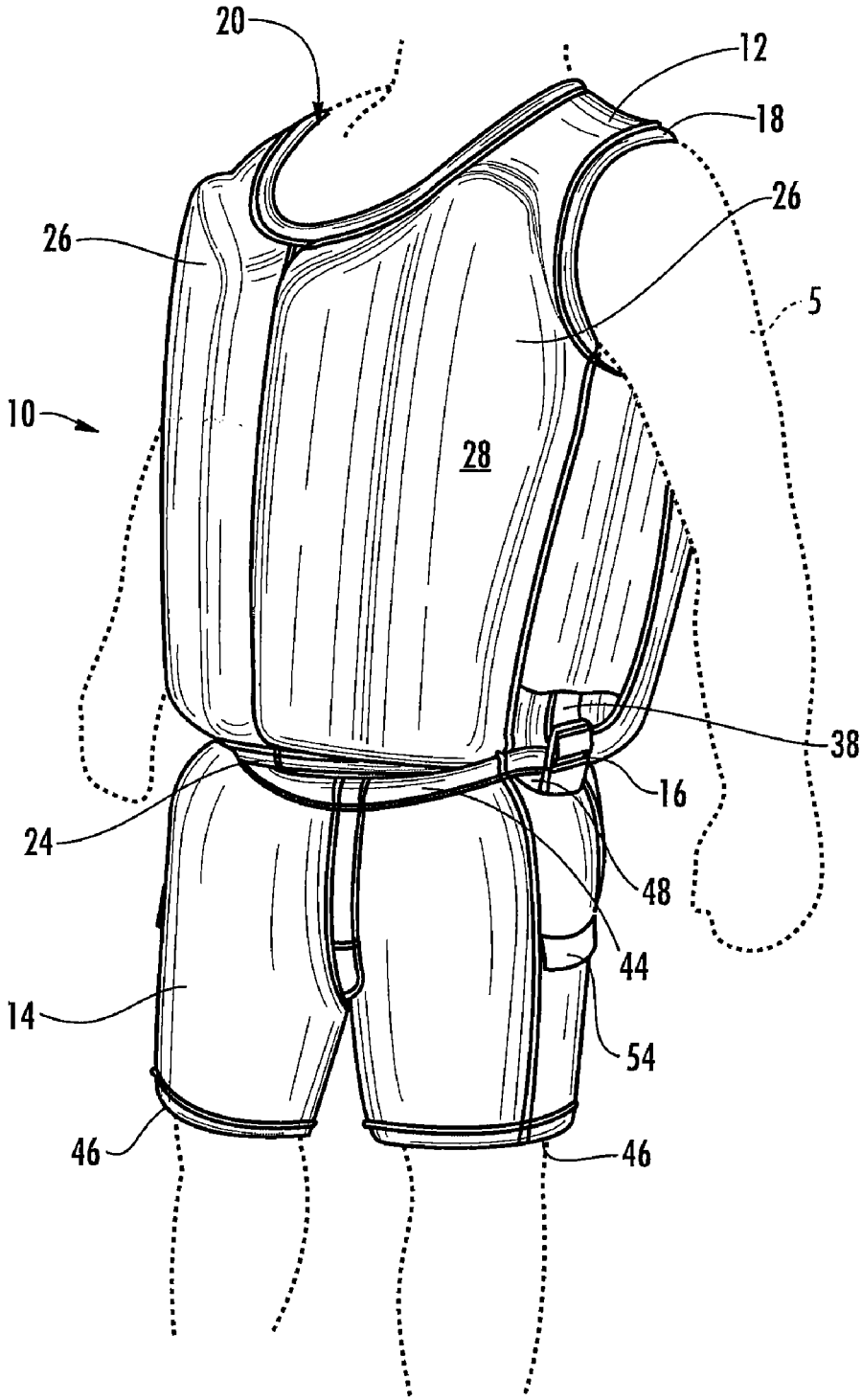
FIG. 1 is an isometric view of a swim garment according to one embodiment of the present invention.
Figure 2:
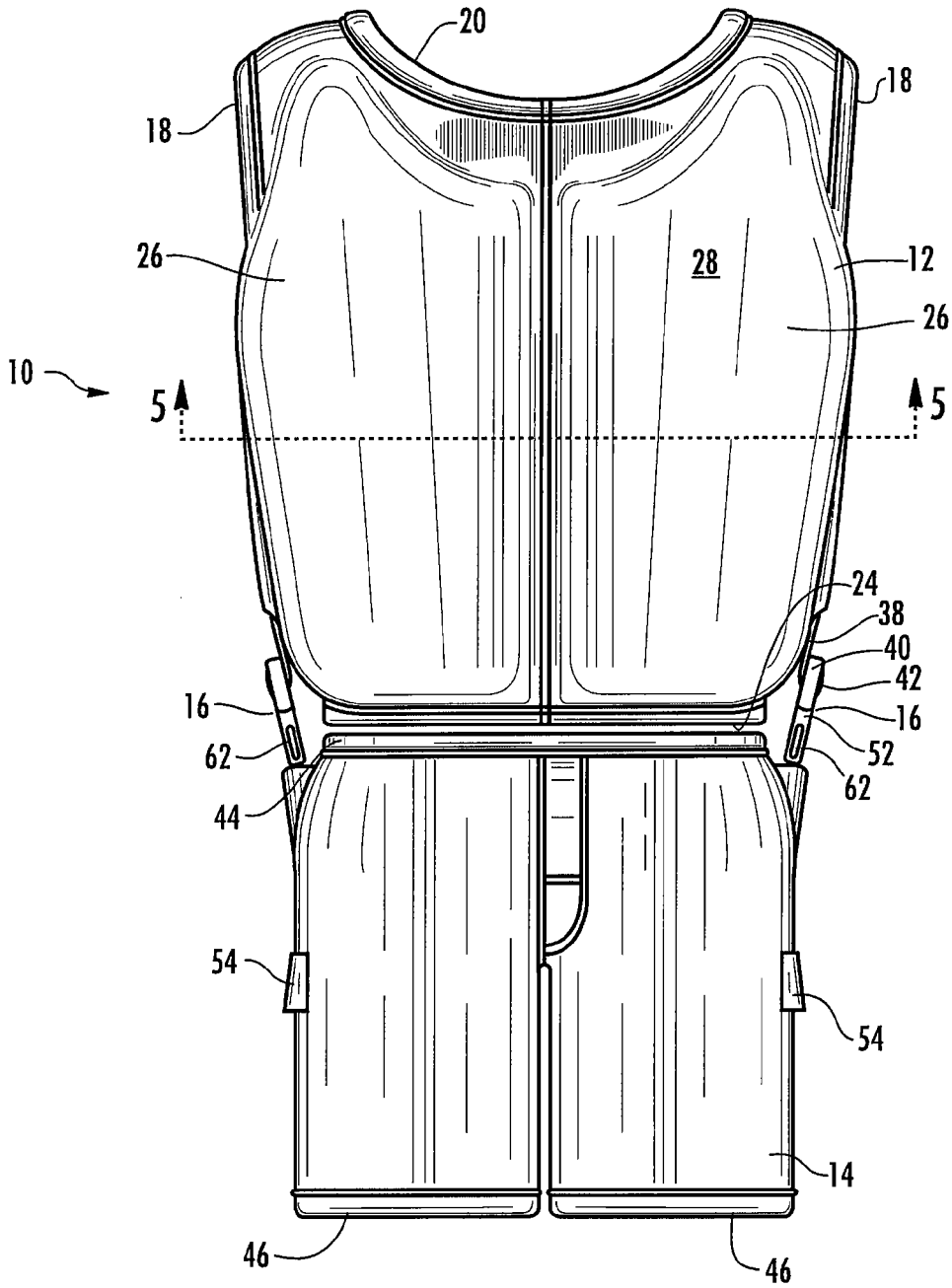
FIG. 2 is a front view of the swim garment shown in FIG. 1.
Figure 3:
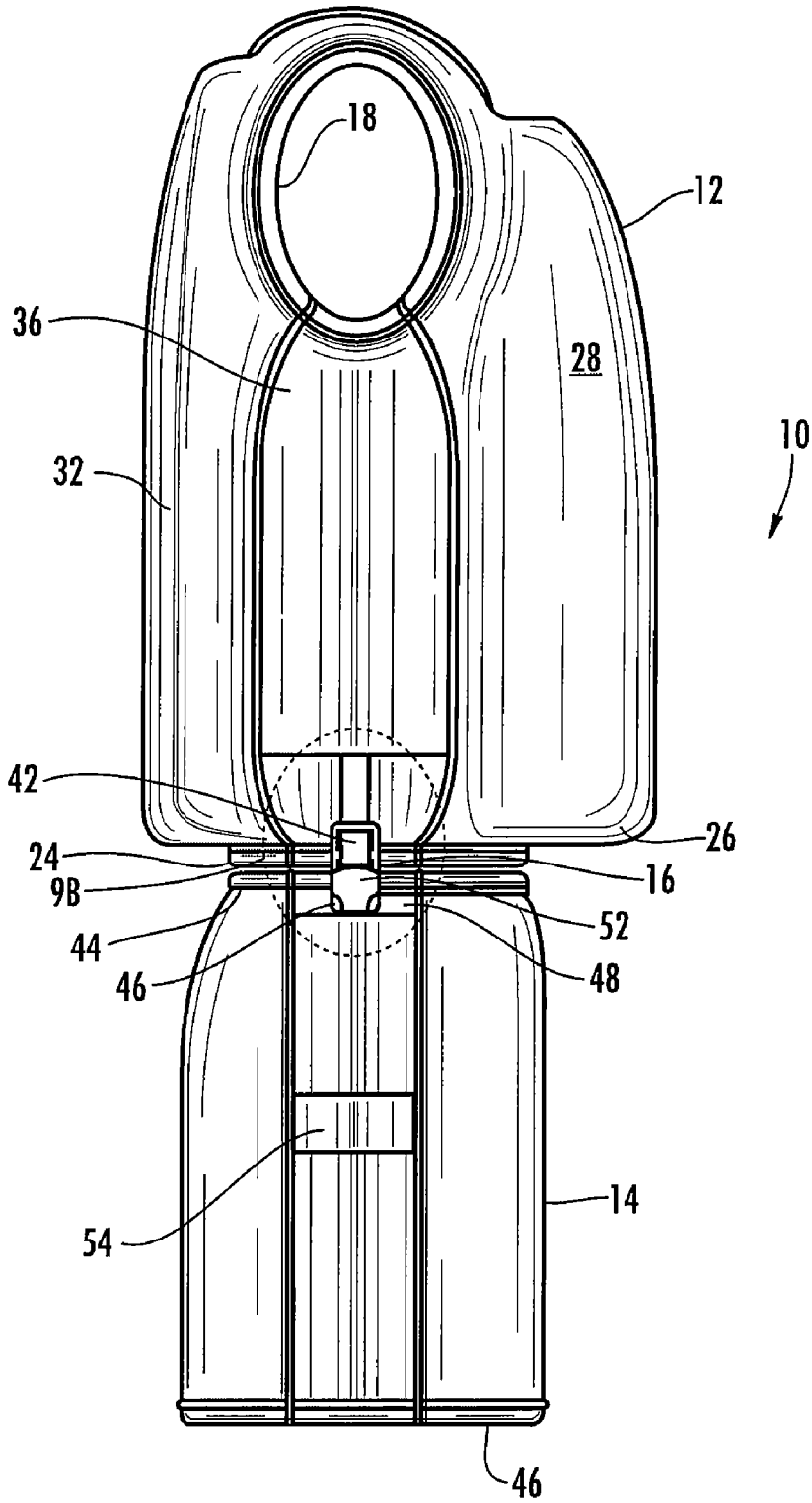
FIG. 3 is a left side elevation view of the swim garment of FIG. 1.

A first embodiment of a swimsuit 10 according the present invention is disclosed in FIGS. 1-8. The outline of a person 5 is indicated in FIG. 1 to show how the swimsuit 10 would be worn by a user. The swimsuit 10 is intended as a garment to be worn while swimming, or performing other water-related activities. As such, the materials should be chosen such that they will remain colorfast, and will not deteriorate in water.

The swimsuit 10 includes an upper portion in the form of a vest 12 and a lower portion in the form of trunks 14. It should be understood that while the trunks 14 shown in FIGS. 1-8 are of a style commonly worn by boys or men, the shape and style of the trunks could be modified to an appearance more commonly associated with girls and womens swimwear. A coupling mechanism 16 is provided to securely couple the vest 12 with the trunks 14. It is important that the vest 12 be securely fastened to the trunks 14 when in use in order to secure the vest 12 from slipping off the user 5. In the embodiment shown in FIGS. 1-8, the coupling mechanism 16 includes two buckle-and-strap mechanisms provided along the sides of the trunks 14 and vest 12.

Figure 4:
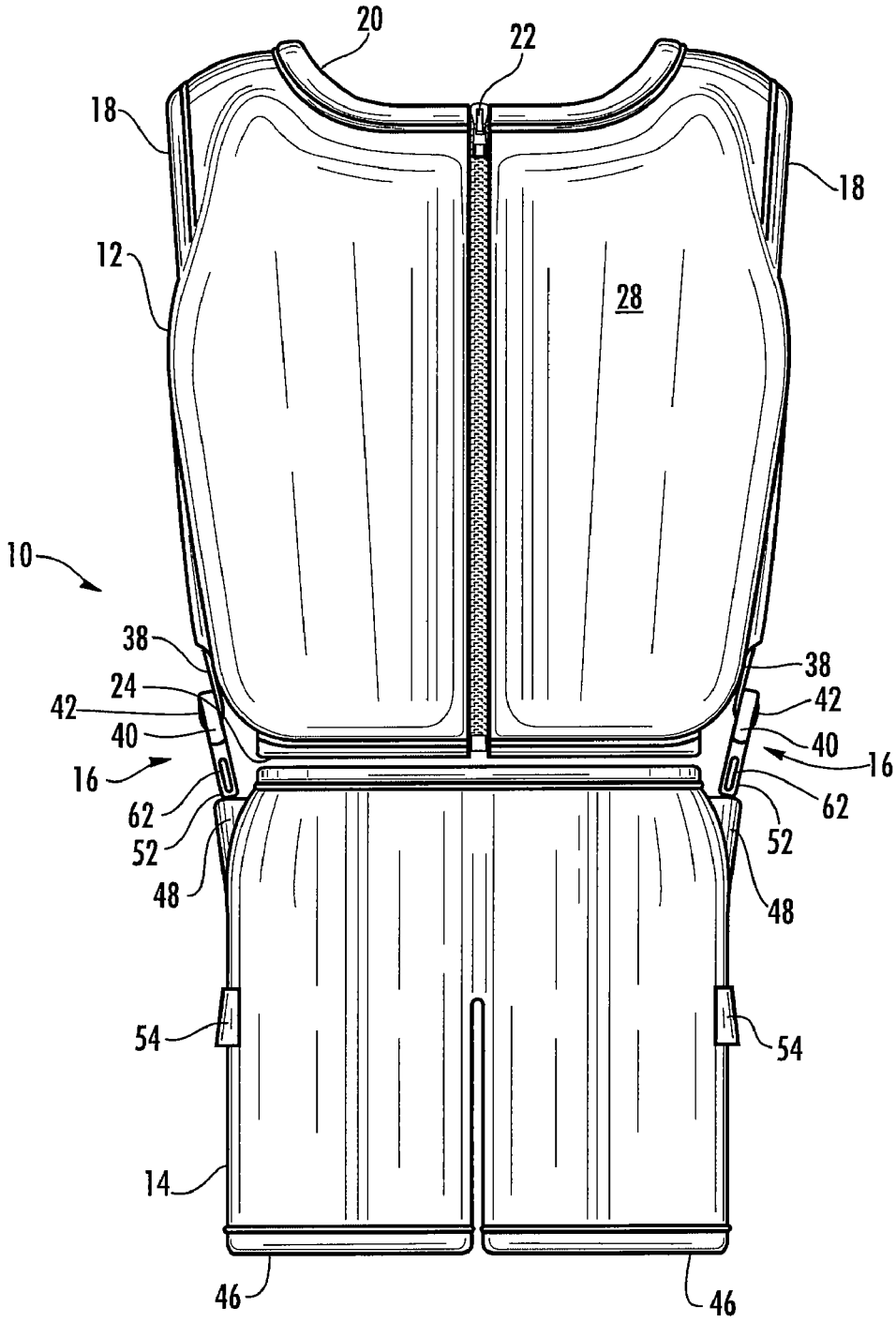
FIG. 4 is a rear elevation view of the swim garment shown in FIG. 1.
Figure 5:
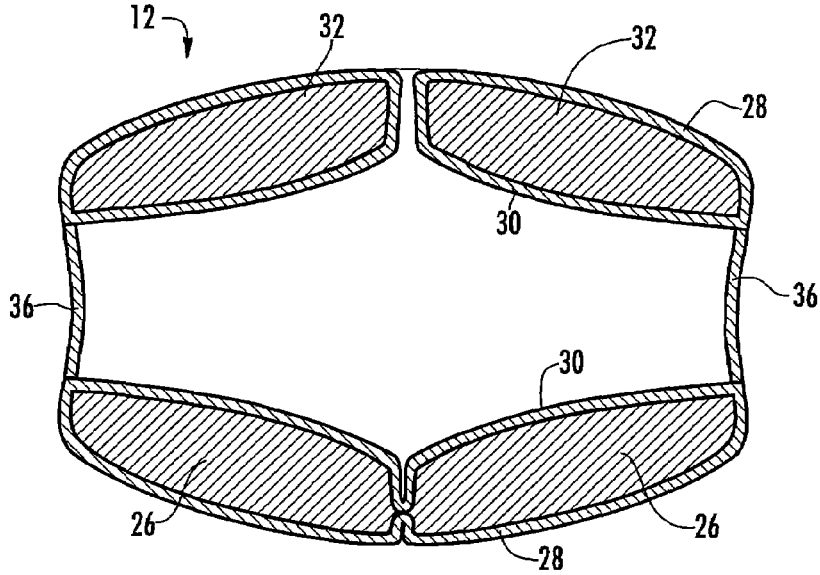
FIG. 5 is partial cross-sectional view of the vest portion of the swim garment of FIG. 1 taken along line 5-5 of FIG. 2.

The vest 12 is adapted to be worn generally over the torso of a user 5. As such, the vest 12 is provided with arm openings 18 and a neck opening 20. The vest 12 may be worn with (FIG. 1) or without (FIG. 7) the matching trunks 14. As best seen in FIG. 4, this embodiment of the vest 12 includes a full-length zipper 22 that extends from the neck opening 20 to a torso opening 24. The zipper 22 is shown in a closed configuration in FIG. 4 and in an open configuration in FIG. 8. The open configuration of FIG. 8 is used to put on and take off the vest 12. In the embodiment shown, the zipper 22 is provided on the back of the vest 12 so that it will be difficult for a wearer to adjust the zipper 22. The location of the zipper on the back of vest 12 is thus most suitable for use with children as a safety feature to prevent them from removing the vest 12. While not shown, it should be appreciated that the zipper 22 could be located on the front of the vest 12, especially if the swimsuit 10 is intended for use by adults or older children. Additionally, it may not be necessary in all instances to have the zipper 20 extend the full length from the neck opening 20 to the torso opening 24. A partial length zipper could be sufficient to permit the easy attachment and removal of the vest 12 to a user 5 by slipping the vest 12 over the user's head. Similarly, in some instances, the material used to from the vest 12 may have sufficient resiliency that no zipper is needed, and the vest 12 could be slipped on and off over the user's head like a shirt. It should also be appreciated that instead of a zipper 22 other closure devices, such as hook and loop fasteners (VELCRO), buttons, snaps, hooks, buckles and the like could be used.

The front portion of vest 12 that would cover a user's chest includes a pair of front flotation members 26 retained between an outer shell 28 and a liner 30. In the embodiment of FIGS. 1-8, the front flotation members 26 are made from a light-weight relatively rigid water impermeable foam. A preferred material for the front flotation members 26 is a PVC closed cell foam, sold under the brand name WINBOSS 201. Similarly, a pair of rear flotation members 32 made from the same or different material as the front floatation member 26 are retained between the outer shell 28 and liner 30 on the rear portion of the vest 12. The flotation members 26 and 32 are preferably contoured to ergonomically match, at least roughly, the portion of a user's body on which they align with when in use. The two front flotation members 26 could be replaced by a single flotation member; however, it is preferred to use two separate pieces in order to improve the flexibility and comfort of the vest 12 and to allow for easier movement of a person 5 wearing the vest 12. Conversely, the front flotation members 26 could be divided into more than two members. The flotation members 26 and 32 taken together should have sufficient volume to provide the buoyancy necessary to maintain a user's head above water. Also, it is desirable to arrange the flotation members 26 and 32 generally symmetrically laterally on the vest 12 so that a user 5 will tend to float in a generally upright orientation without a side-to-side tilt. It may be preferable to provide additional volume to the front flotation members 26 in relation to the rear flotation members 32 50 that a person 5 wearing the vest 12 will tend to tilt slightly to the rear such that the user's mouth and nose are held away from the water. According to another embodiment of the present invention the foam floatation members 26 are provided with openings or perforations to allow ventilation when a wearer is out of the water.

In the embodiment of FIGS. 1-8, the flotation members 26 and 32 are held in place by being sandwiched between the outer shell 28 and liner 30. The outer shell 28 is preferably formed from a light weight durable flexible material that has high resiliency such that it will stretch across and cling to the flotation members 26 and 32 to hold them in place. The liner 30 may similarly be formed from the same material. The flotation members 26 and 32 may each be individually held in place by stitching the outer shell 28 to the liner 30 in a perimeter surrounding each individual flotation member 26 or 32. A material such as spandex is well suited to this purpose. The outer shell 28 may be formed from one or more pieces of material, and may have trim items of the same or different material added for appearance, and durability, especially along the arm openings 18, neck opening 20, and torso opening 24. Similarly, the liner 30 may be formed from a single sheet of material, or may be made from multiple pieces of material stitched together.

Side panels 36 are provided generally from the bottom of the arm openings 18 down to the torso opening 24 between the front and rear portions of the vest 12. The side panels 36 act as a connection and support to hold the front and rear portions of the vest 12 together. The side panels 36 are preferably formed from a highly durable fabric that is relatively inelastic. A fabric sold under the brand name SUPPLEX has been found to be especially well suited for use in forming the side panels 36. In one embodiment a 6.3 ounce poly-spandex may be used. The side panels 36 may be joined to the outer shell 28 and liner 30 by stitching, which is the preferred method, or by other suitable mechanisms such as rivets, welding, or adhesive.

A top portion of the coupling mechanism 16 in the form of an upper strap 38 is attached to each side panel 36, preferably near the torso opening 24. The upper strap 38 should preferably be a highly durable flexible material, such as a knit elastic belt. The upper strap 38 may be attached to the side panel 36 through the use of a single needle box-x lock stitch. Other manners of attaching the upper strap 38 to the side panels 36 would also be acceptable. In the embodiment shown, a male buckle portion 40 is attached to the free end of the upper strap 38, for example by a loop 42 formed at the end of the upper strap 38 (see FIGS. 9*a* and 9*b*). Numerous other attachment devices may be used instead of male buckle portion 40, including, for example, hook and loop fasteners (VELCRO), buttons, snaps, loop-type belt buckle, or hole and tine type belt buckle.

The trunks 14 may generally be of any desired form, including shorts, bikini type, or wetsuit with knee-length or full-length pant legs. The trunks 14 have a waistband portion 44 for encircling and engaging a user's waist. Leg openings 46 are provided at the end of the pant legs. The material used to form the trunks 14 may be any suitable material that is used to form swim trunks. Most preferably, the material used for the trunks 14 will match the material used in forming the vest 12 in color and design. A pair of attachment panels 48 made of a relatively durable inelastic material, such as that sold under the brand name SUPPLEX, are provided on the trunks 14. Preferably, this attachment panel 48 will be located near the waistband 44 and will be in alignment with the side panels 36 of the vest 12 when the vest 12 and trunks 14 are being worn by a user 5. A lower portion of each coupling mechanism 16 is fastened to the trunks 14 in the form of a lower strap 50 (see FIG. 9*a*) or gusset stitched to the corresponding attachment panel 48. Again, the preferred mechanism for attaching the lower straps 50 to the attachment panel 48 is through use of a single needle box-x lock stitch. Other attachment mechanisms may be used instead of, or in addition to the lock stitch, such as rivets or adhesive. A female buckle member 52 is attached to the free end of lower strap 50, and is suited for mated engagement with male buckle portion 40. The trunks 14 may be provided with one or more pockets, or other useful or decorative features.

Figure 6:
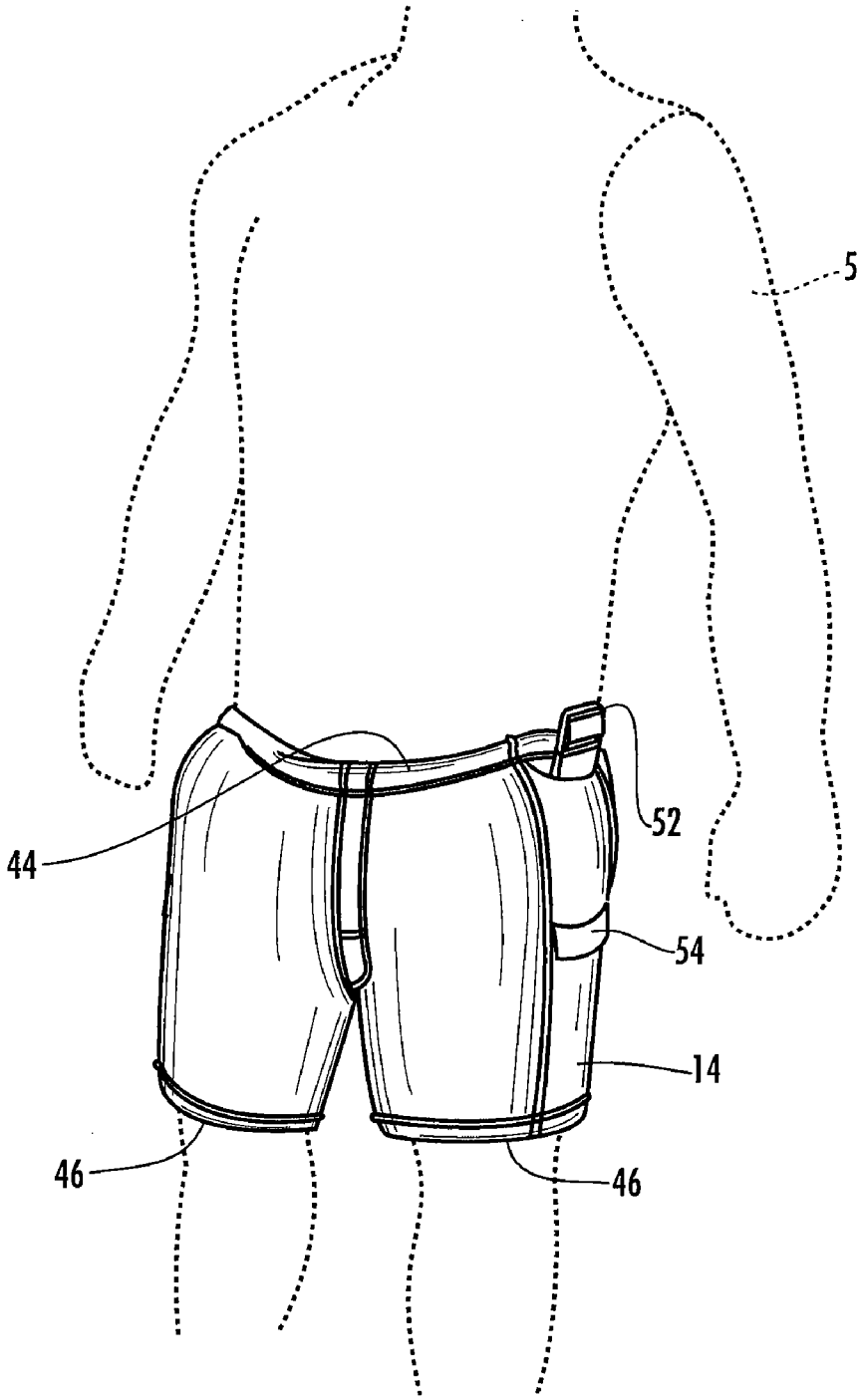
FIG. 6 is an isometric view of the trunks portion of the swim garment shown in FIG. 1 with a user shown in phantom lines.

As best seen in FIG. 6, the trunks 14 may be worn by themselves without the vest 12. In this configuration, the trunks 14 function like any other swim trunks. This is especially useful because it can be desirable to remove the vest 12 when not in the water so that a user 5 remains cooler, and less constrained. Also, it can be desirable to remove the vest 12 when it is wet, as it can be unpleasant to wear wet garments. Furthermore, there can be some situations where a person may need the flotation vest 12 only some of the time while swimming. For example, a child may be able to play safely in the shallow end of the pool, but may need a flotation device for playing in the deep end.

Figure 7:
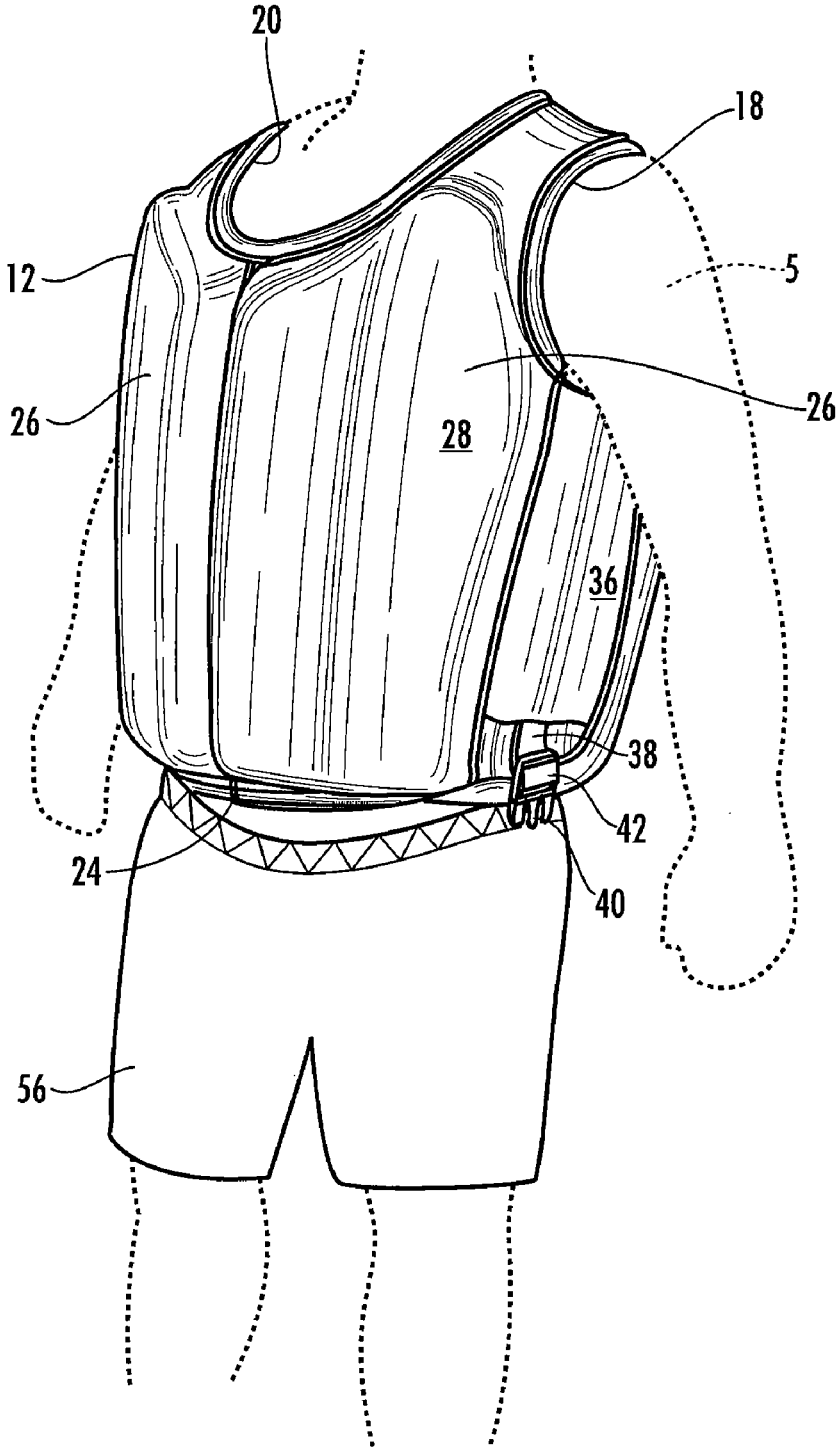
FIG. 7 is an isometric view of the vest portion of the swim garment of FIG. 1 with a user indicated in phantom lines wearing the vest portion of the swim garment from FIG. 1 and an unmatched pair of swimming trunks.
Figure 8:
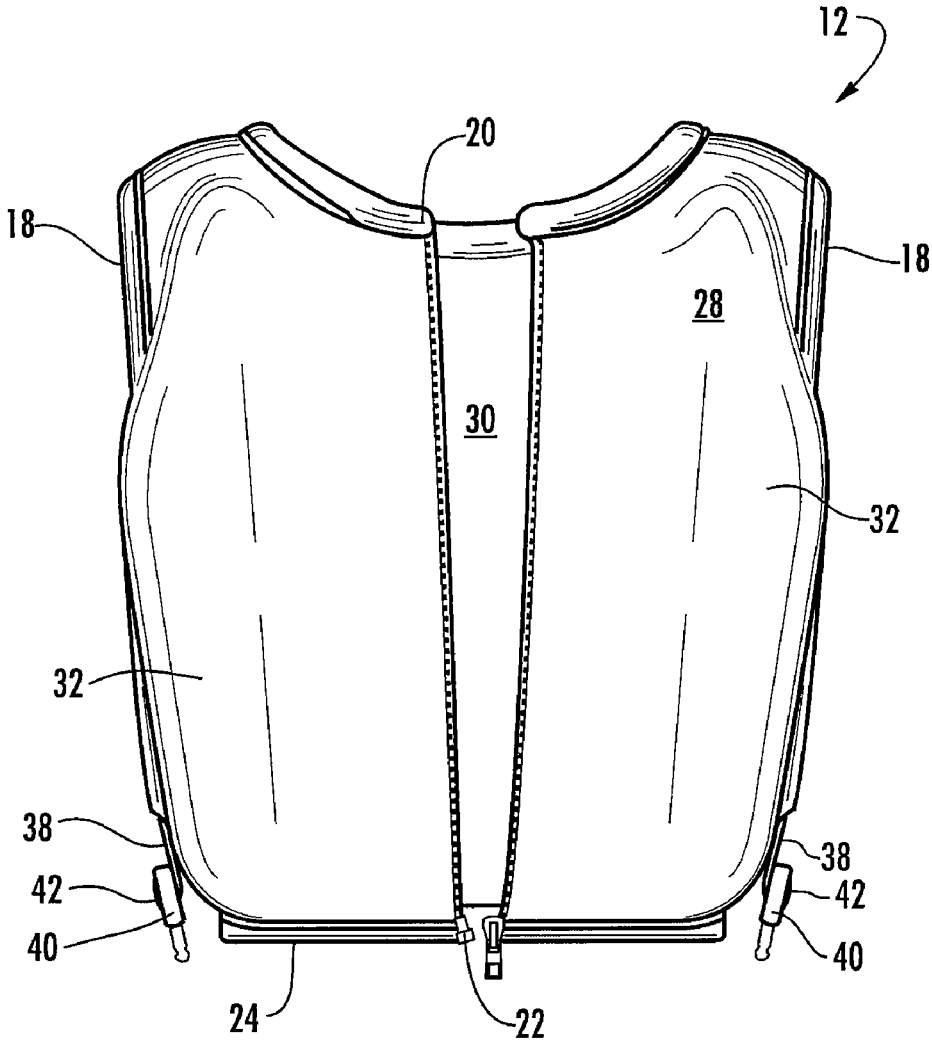
FIG. 8 is a rear elevation view of the vest portion of the swim garment shown in FIG. 1 with a zipper adjusted to an open position to permit a user to put on and take off the vest portion.

Similarly, as seen in FIG. 7, the vest 12 can be worn without the matching trunks 14. For example, non matching shorts 56 could be worn with the vest 12 in case the matching trunks 14 were soiled or damaged. More preferably, it is desirable to be able to remove the trunks 14 in order to permit a user to use the restroom, or in the case of small children, to have their diaper changed. It is not recommended that a user 5 swim with the configuration shown in FIG. 7 because there is a risk that the vest 12 could slip off of the user 5 if it is not secured to the trunks 14 by the coupling mechanism 16.

Figure 20:
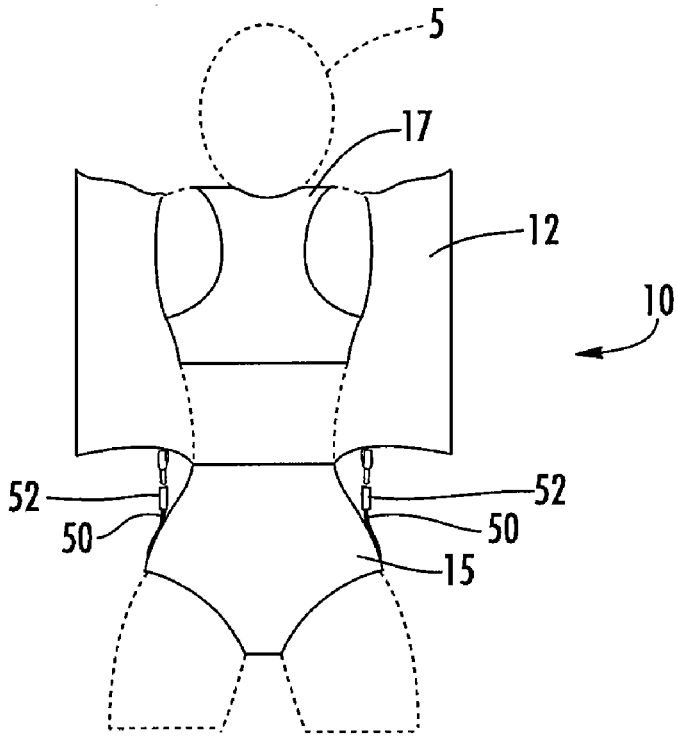
FIG. 20 is a rear elevation view of a swim garment according to one embodiment of the present invention incorporating a matching bikini bottom and top with a buoyant vest.

FIG. 20 shows a girls swimsuit 11 according to one embodiment of the present invention. It functions identically with the swimsuit 10 described above with respect to FIGS. 1-8, but is adapted to match the style of suit preferred by girls. Specifically, the trunks 14 are replaced in the girls swimsuit 11 by bikini bottom 15. Additionally, a bikini top 17 is provided. Preferably, the bikini top 17 will match the bikini bottom 15 so that if a user 5 removes the vest 12 the user 5 will be wearing a matching bikini type swimsuit. The bikini bottom 15 is provided with a portion of a coupling mechanism 16, such as a female buckle member 52, in order to be coupled with and securely fastened to the vest 12, as described above.

Figure 21:
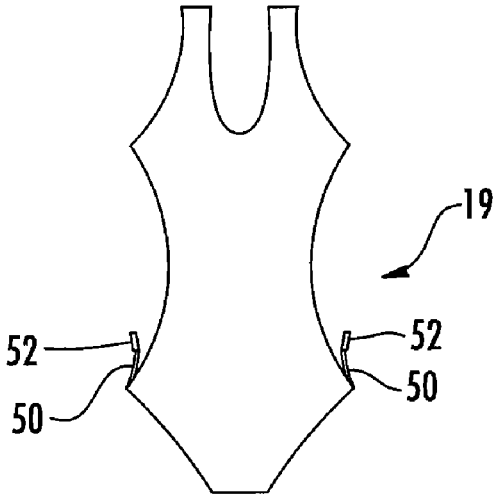
FIG. 21 is a front elevation view of a one-piece girls swimsuit suitable for use with a buoyant vest according to one embodiment of the present invention.

FIG. 21 shows a one piece girls swimsuit 19 that is adapted for use with the vest 12 according to one embodiment of the present invention. The one piece swimsuit 19 is provided with a portion of the coupling mechanism 16, such as a female buckle 52 mounted on a strap 50, for engagement with a male buckle member 40 provided on the vest 12. As with the embodiment of FIG. 20, the one piece swimsuit 19 permits a female wearer to remove the vest 12 and still be appropriately attired in the single piece swimsuit 19. Preferably the coupling mechanism 16 is mounted to the one piece swimsuit 19 along the sides of the bottom portion, or what might be considered the trunk portion, of the one piece swimsuit 19.

Figure 9A:
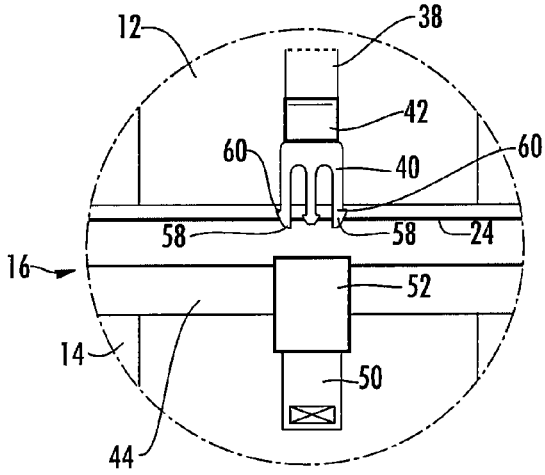
FIG. 9*a* is a partial detail view of a coupling buckle according to one embodiment of the present invention in a detached configuration.
Figure 9B:
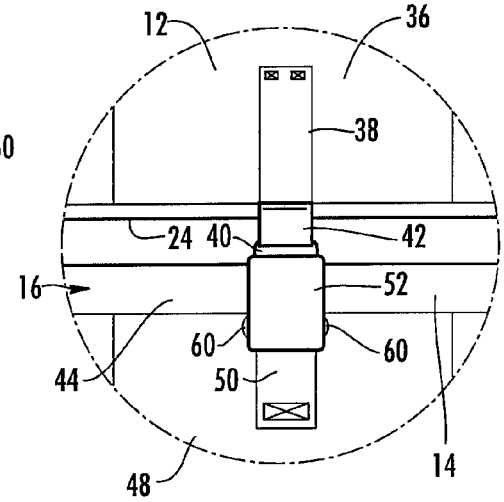
FIG. 9*b* is a partial detail view of the coupling buckle of FIG. 9*a* adjusted to an attached configuration.

FIGS. 9*a* and 9*b* illustrate a coupling mechanism 16 according to one embodiment of the present invention. FIG. 9*a* shows the coupling mechanism 16 in a detached configuration such that the trunks 14 and vest 12 are not coupled together and may be freely removed from a user's body. The male buckle portion 40 includes two resilient tines 58 that include locking protrusions 60. In order to adjust the coupling mechanism 16 into the coupled configuration of FIG. 9*b*, the resilient tines 58 of the male buckle portion 40 are inserted into the female buckle portion 52. Preferably, the resilient tines 58 have a tapered leading edge that guides the male buckle portion 40 into the female buckle portion 52, while flexing the resilient tines 58 inwardly towards each other. The female buckle portion 52 is provided with slots 62 (not visible in FIGS. 9*a* and 9*b*, see FIG. 2) along its outer edges. When the male buckle portion 40 is slid sufficiently far into the female buckle portion 52, the resilient tines 58 will snap outwardly such that the locking protrusions 60 are engaged by and retained within the slots 62. In order to move from the coupled configuration of FIG. 9*b* to the detached configuration of FIG. 9*a*, locking protrusions 60 are squeezed inwardly until the locking protrusions 60 are at least partially clear from the slots 62 and the male buckle portion 40 is withdrawn from the female buckle portion 52. It is preferred that at least two such coupling mechanisms 16 be used to securely fasten the vest 12 to the trunks 14. Additional coupling mechanisms 16 may be utilized for additional security.

Figure 10:
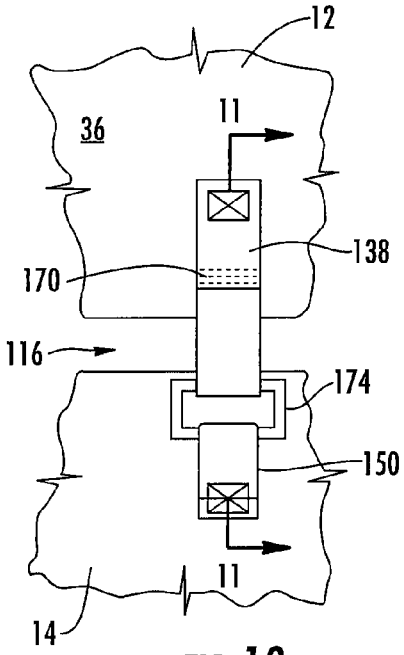
FIG. 10 is a partial detail front elevation view of a connection mechanism including a hook and loop strap according to one embodiment of the present invention.
Figure 11:
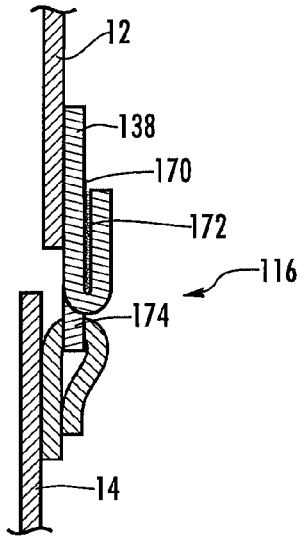
FIG. 11 is a cross-sectional view of the connection mechanism of FIG. 10.

FIGS. 10 and 11 show a coupling mechanism 116 according to an additional embodiment of the present invention. The coupling mechanism 116 includes an upper strap 138 stitched, or otherwise fastened to the side panel 36 of the vest 12. The upper strap 138 includes a portion of hooks 170 and a portion of loops 172 of the kind used in hook-and-loop fasteners sold under the brand name VELCRO. A lower strap 150 is stitched, or otherwise fastened, to an upper portion of the trunks 14. A rectangular ring or eyelet 174 is fastened to the lower strap 150 by a loop formed at the end of the strap 150. The vest 12 and trunks 14 may be selectively coupled together by looping the free end of upper strap 138 through the eyelet 174, and pressing the hook portion 170 against the loop portion 172 to capture the eyelet 174. In order to uncouple the trunks 14 from the vest 12, the loop portion 172 of the upper strap 138 is pulled away from the hook portion 170, and the upper strap 138 is withdrawn from the eyelet 174. It is desirable to use at least two of such coupling mechanisms 116 to securely couple the vest 12 to the trunks 14. Additional coupling mechanisms 116 may be used to more securely couple the vest 12 and trunks 14. The coupling mechanism 116 provides additional flexibility and adjustability in spacing the vest 12 from the trunks 14.

Figure 12:
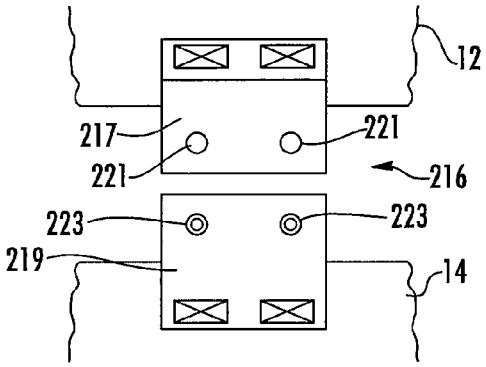
FIG. 12 is a partial detail isometric view of a connection mechanism incorporating snap fasteners according to an embodiment of the present invention.

FIG. 12 illustrates an additional embodiment of a coupling mechanism according to the present invention. The coupling mechanism 216 includes a top flap 217 stitched or otherwise fastened to the vest 12, and a bottom flap 219 stitched or otherwise fastened to the top portion of the trunks 14. The top flap 217 is provided with a pair of snaps 221 that include male portions (not shown) that extend through the top flap 217. The male portions of the snaps 221 are suited to be engaged by snap bases 223 with a tight interference fit to retain the snaps within the snap bases and thereby couple the vest 12 with the trunks 14. The snaps 221 can be disengaged from the snap bases 223 by pulling the top flap 217 apart from bottom flap 219. The coupling mechanism 216 could be provided with more than two such pairs of snaps 221 and snap bases 223. Again, it is desirable to include at least two such coupling mechanisms 216 on the swim suit 10, in order to securely couple the vest 12 with the trunks 14.

Figure 13:
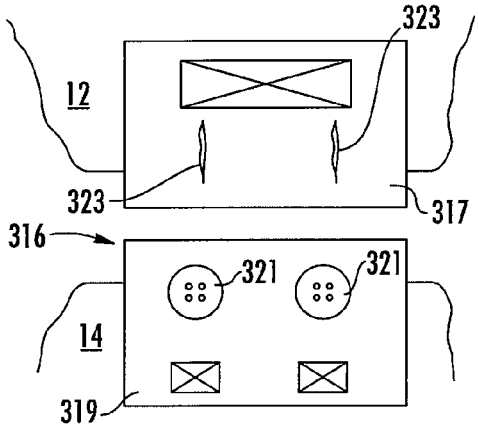
FIG. 13 is a partial detail isometric view of a connection mechanism incorporating buttons and button holes according to another embodiment of the present invention.

FIG. 13 shows yet another embodiment of a coupling mechanism 316 according to the present invention. A top flap 317 is stitched or otherwise fastened to the vest 12, and is provided with buttonholes 323. A bottom flap 319 is stitched or otherwise fastened to the top portion of trunks 14 and includes a pair of buttons 321. The buttons 321 may be inserted through the button holes 323 in order to couple the vest 12 with the trunks 14. At least two such coupling mechanisms 316 should be used in order to securely couple the vest 12 with the trunks 14. Each coupling mechanism 316 may include any number of pairs of buttons 321 and buttonholes 323. The buttons 321 may be fastened to the bottom flap 319 by stitching, or other conventional means. Alternatively, the buttons 321 could be stitched directly to the top portion of the trunks 14. Also, it should be appreciated that the buttons 321 and the buttonholes 323 could be reversed such that the buttons 321 are provided on the top flap 317 and the buttonholes 323 are provided on the bottom flap 319.

Figure 14:
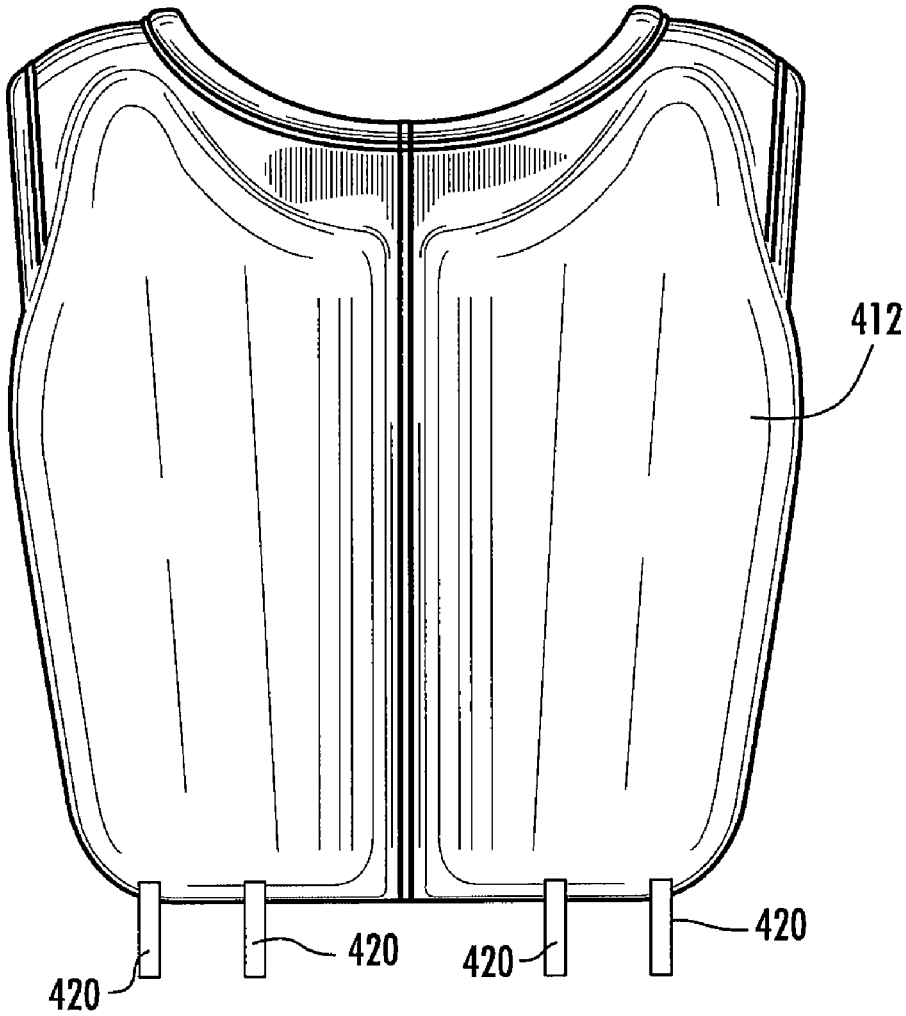
FIG. 14 is a front elevation view of a buoyant vest incorporating belt loops as part of a coupling mechanism according to one embodiment of the present invention.
Figure 15:
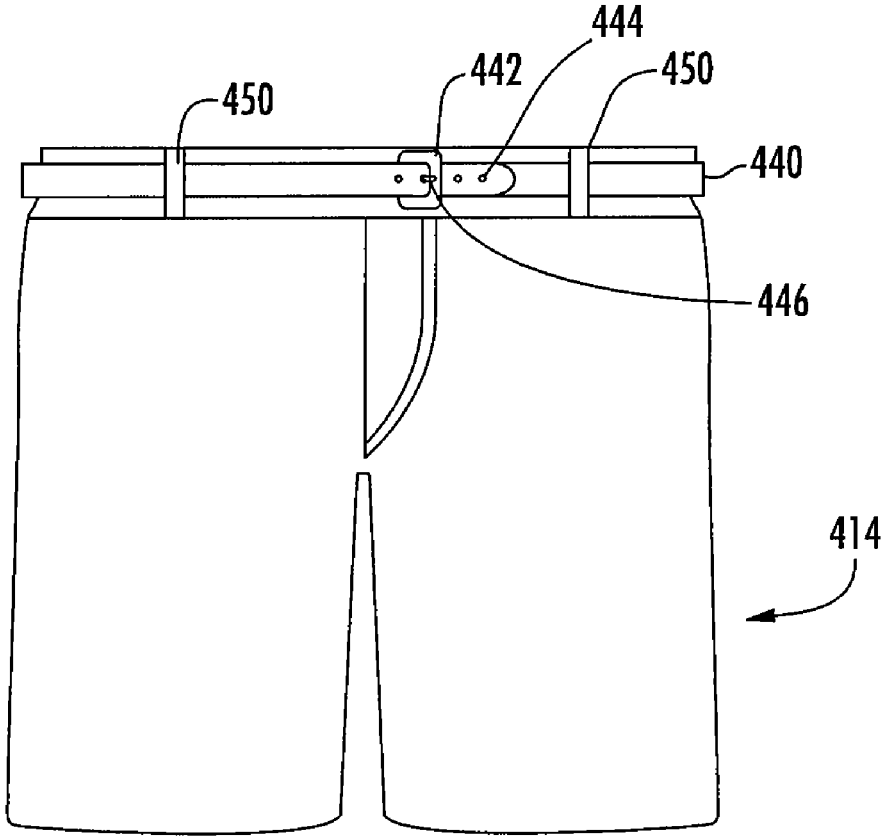
FIG. 15 is a front elevation view of a pair of trunks that are suitable for connection to the buoyant vest of FIG. 14.
Figure 16:
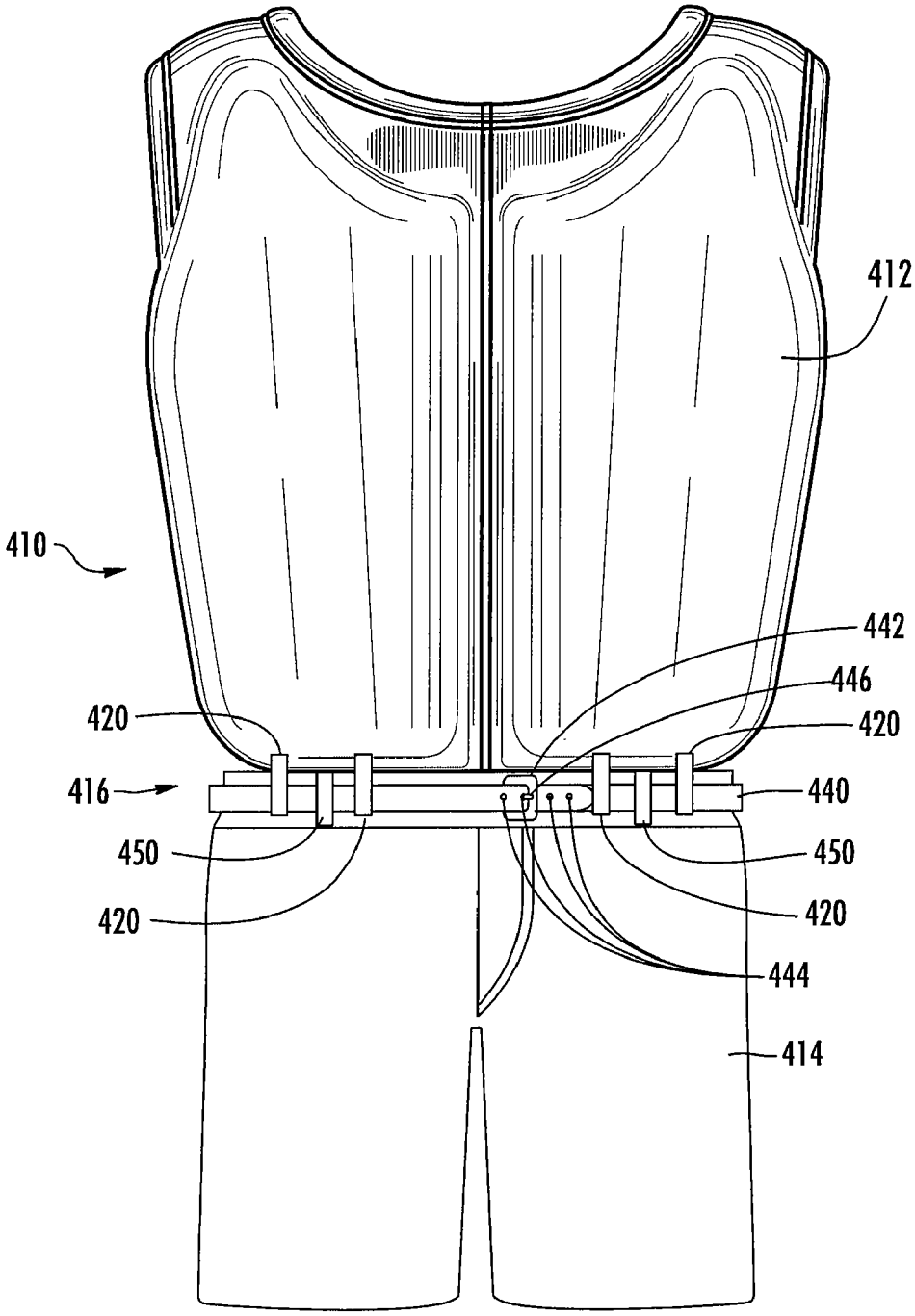
FIG. 16 is a front elevation view of a swimsuit formed by the buoyant vest of FIG. 14 coupled to the trunks of FIG. 15.

FIGS. 14 through 16 show an embodiment of a swimsuit 410 according to the present invention. As seen in FIG. 14, the vest 412 is of similar design to that already described herein, except that the vest 412 is provided with one or more loops 420 that extend below the torso opening of the vest 412. These loops 420 may be attached by stitching, adhesive, rivets, staples, or the like. As seen in FIG. 15, the trunks 414 are provided with a belt 440 that is constrained by belt loops 450. The belt 440 may be adjustable in length by using belt buckle 442 that has tine 446 to engage one of a series of holes 444 provided in the belt 440. The belt 440 may extend around the entire waistband of the trunks 414, or may be in the form of two separate belts that each extend partially around the waistband.

FIG. 16 shows the swimsuit 410 in a coupled configuration with the vest 412 coupled to the trunks 414. In this configuration, the belt 440 is threaded through the loops 420 on the vest 410 and through the belt loops 450 on the trunks 414. The loops 420, belt loops 450, and belt 440 thereby form a coupling mechanism 416 to securely couple the vest 412 to the trunks 414. To detach the trunks 414 from the vest 412, the belt 440 is unbuckled and withdrawn from the loops 420 and belt loops 450. The belt 440 may then be rethreaded through the belt loops 450 to revert to the configuration shown in FIG. 15.

Figure 17:
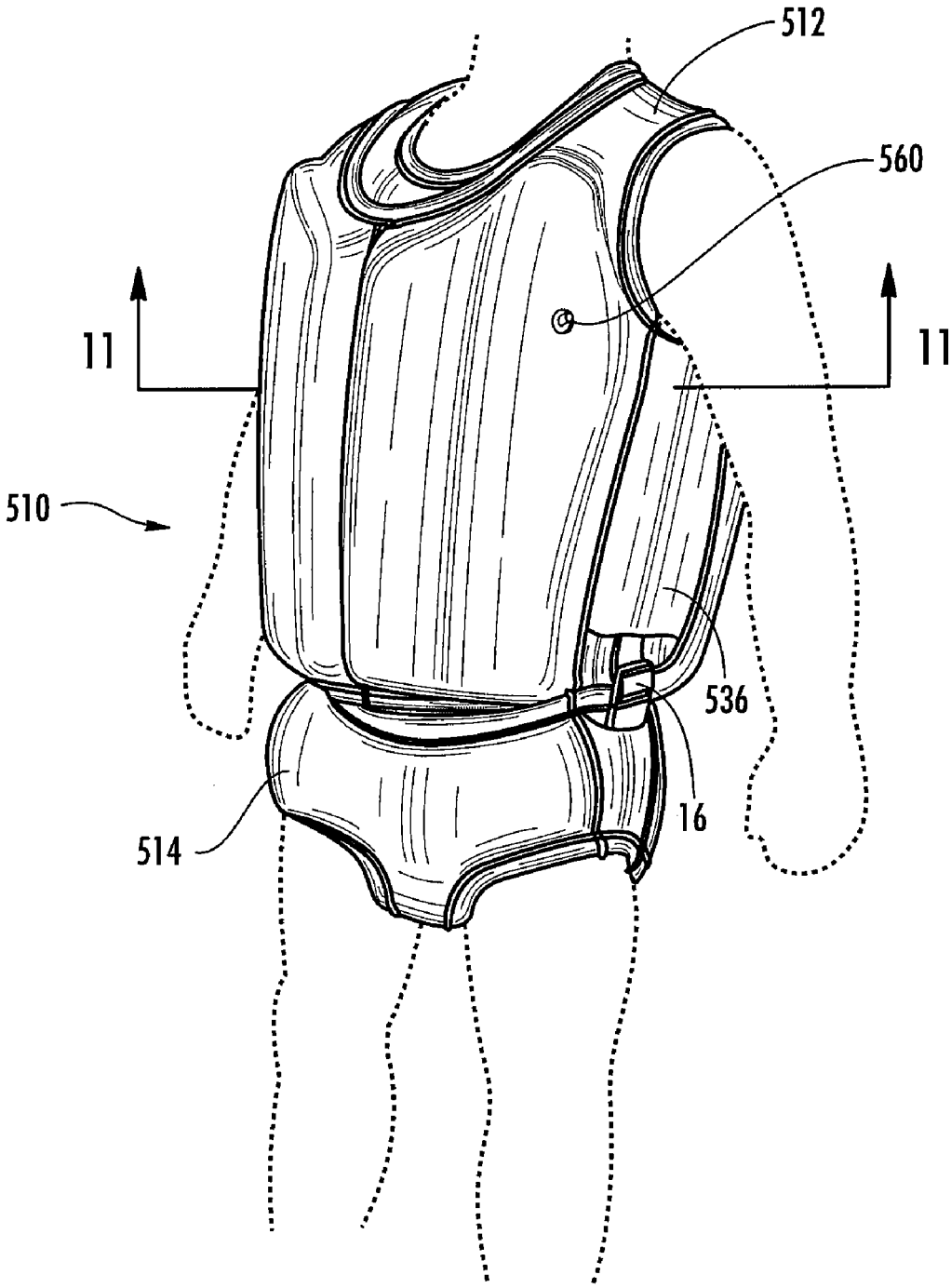
FIG. 17 is an isometric view of a two-piece swim garment with an incorporated inflatable flotation member according to one embodiment of the present invention.
Figure 18:
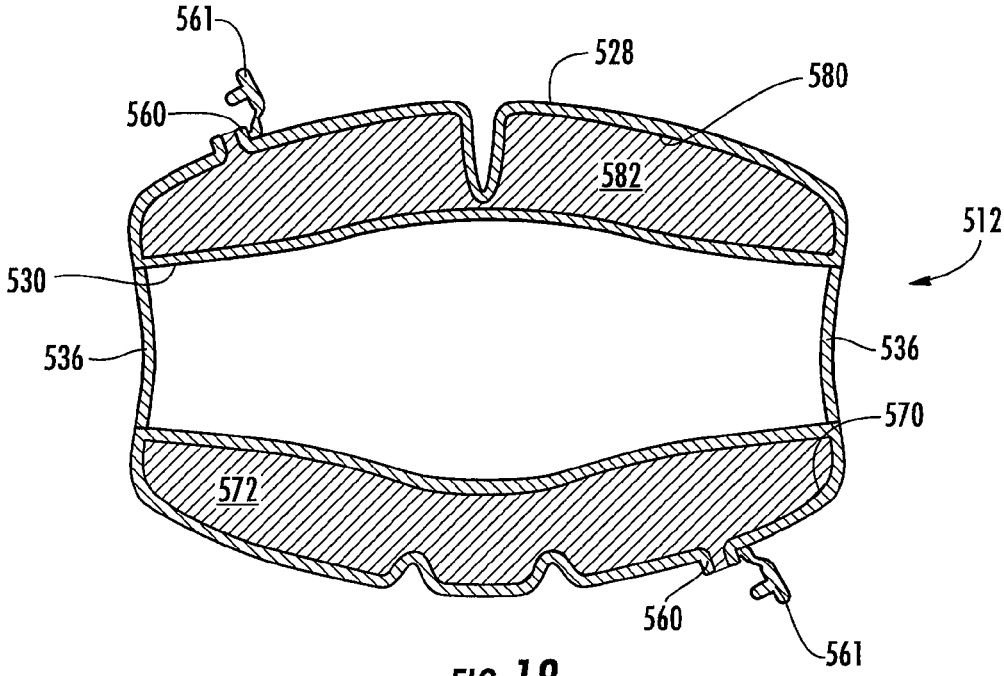
FIG. 18 is a partial cross-sectional view of the vest portion of the swim garment shown in FIG. 17 taken along line 11-11 of FIG. 17.

FIGS. 17 and 18 show an additional embodiment of a swimsuit 510 according to the present invention. The swimsuit 510 includes a vest 512 that is provided with inflatable front flotation member 570 and inflatable rear flotation member 580. Valves 560 including removable caps 561 are provided to permit inflation of the inflatable flotation members 570 and 580. The front flotation member 570 is in the form of an airtight bladder 572 that may be inflated with air, as by blowing through the valve 560 with a user's mouth, or pump. The rear flotation member 580 is in the form of an airtight bladder 582 that may similarly be inflated. The inflated bladders 582 and 572 provide buoyancy for the swimsuit 510. The bladders 572 and 582 are retained in place by being sandwiched between a liner 530 and an outer shell 528. Preferably, the liner 530 and outer shell 528 are made from a resilient stretchable flexible thin fabric such as spandex. Side panels 536 span between the front and rear portion of the vest 512. Coupling mechanism 16 is used to securely couple the vest 512 with the trunks 514. The front bladder 572 and rear bladder 582 may be in air flow communication with each other, such that both bladders 572 and 582 may be inflated and deflated through a single valve 560. The vest 512 with the inflatable flotation members 570 and 580 is advantageous in that it can be folded up into a small space when the bladders 572 and 582 are deflated. Additionally, the vest 712 could be worn as a garment top when the bladders 572 and 582 are deflated.

Figure 19:
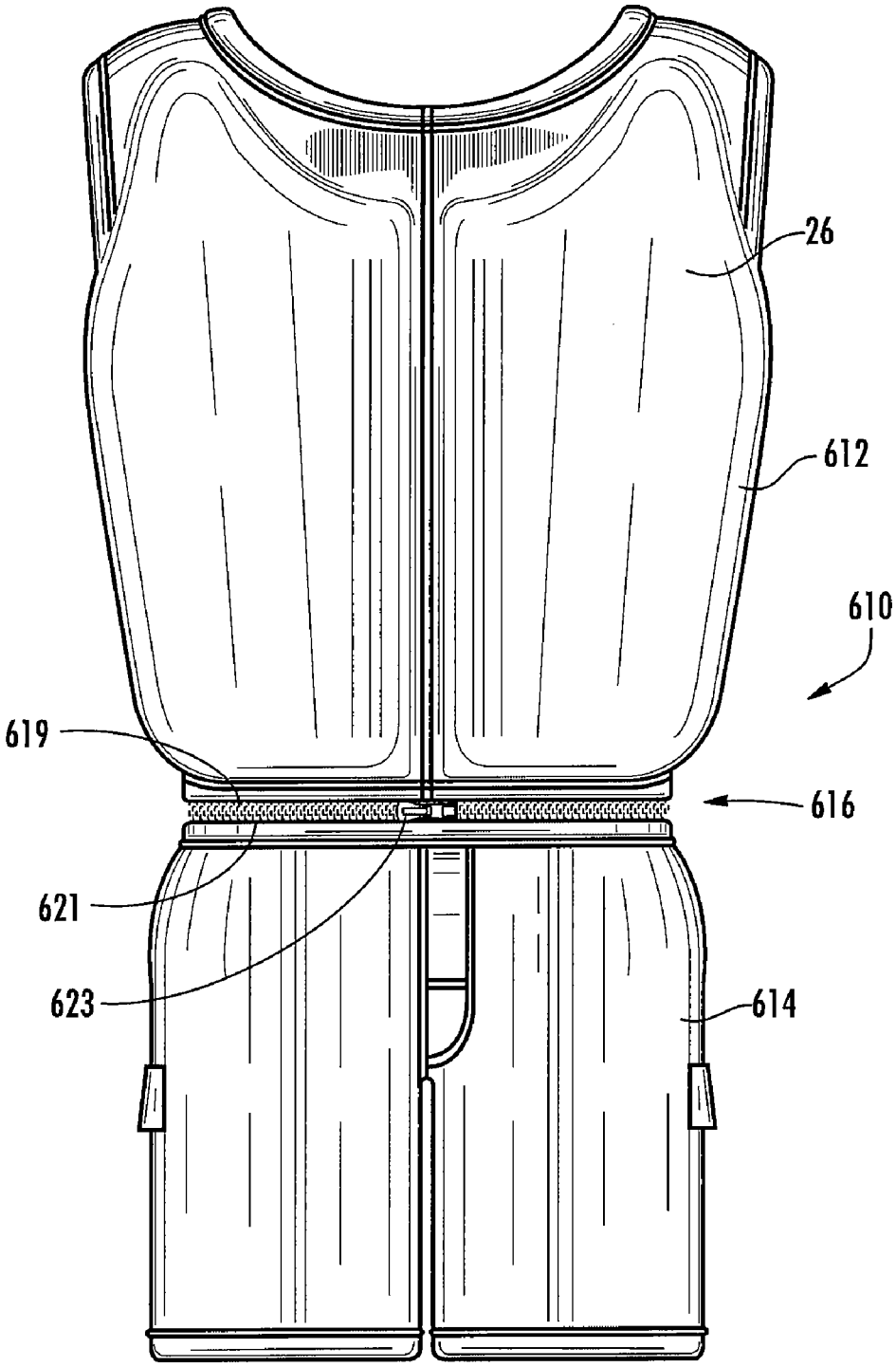
FIG. 19 is a front elevation view of a swim garment according to one embodiment of the present invention wherein a buoyant vest attaches to swimming trunks by a zipper coupling.

FIG. 19 shows a swimsuit 610 according to one embodiment of the present invention. A vest 612 that includes flotation members 26 may be coupled to trunks 614. The vest 612 is provided with a zipper track 619 around the periphery of its torso opening. The trunks 614 are similarly provided with a zipper track 621 around its waistband. Zipper 623 may be used to combine the zipper tracks 619 and 621 into a combined closed configuration as shown in FIG. 19 to couple the vest 612 to the trunks 614. The zipper tracks 619 and 621 and the zipper 623 thereby form an alternative coupling mechanism 616.

Accordingly, the foregoing description and drawings disclose a swimsuit wherein the upper and lower halves may be worn independently of each other or may be coupled together as a single unit. The lower or trunks portion may be easily removed for using the restroom or for changing a diaper. The upper, or flotation vest portion may be easily removed for situations where a wearer would be more comfortable wearing the trunks only.

Although various representative embodiments of this invention have been described above with a certain degree of particularity, those skilled in the art could make numerous alterations to the disclosed embodiments without departing from the spirit or scope of the inventive subject matter set forth in the specification and claims. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In some instances, components are described with reference to "ends" having a particular characteristic and/or being connected with another part. However, those skilled in the art will recognize that the present invention is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

We claim:

1. A swim garment comprising:

a vest adapted to be worn on a user's torso, the vest including at least one floatation element;

a bottom portion adapted to be worn as trunks; and a first coupling device including a first end attached to the vest within a pocket in an outer surface of the vest and a second end carrying a first coupling member, a second coupling device including a first end attached within a pocket on an outer surface of the bottom portion of the swim garment and a second end carrying a second coupling member for coupling to the first coupling member, whereby the first and second coupling devices form a coupling mechanism for selectively attaching and detaching the vest portion to the bottom portion.

2. The swim garment of claim 1 wherein the first coupling device is disposed on a side panel of the vest.

3. The swim garment of claim 1, wherein a plurality of first coupling devices are attached to the vest and a plurality of second coupling devices are attached to the bottom portion of the swim garment for mating with the plurality of first coupling devices.

4. The swim garment of claim 3, wherein the plurality of first coupling devices and plurality of second coupling devices comprise two front coupling devices and two rear coupling devices.

5. The swim garment of claim 4 wherein the plurality coupling devices are offset from a centerline of the user's torso.

6. The swim garment of claim 1 wherein at least one of the first and second coupling devices is a first strap provided with a hook and loop fastener and the other coupling device is a second strap provided with an eyelet that can be engaged by the hook and loop fastener.

7. The swim garment of claim 1 wherein at least one of the first and second coupling devices is a first buckle and the other coupling device is a second buckle engageable with the first buckle.

* * * * *